US005287713A

United States Patent [19]

Mine et al.

[11] Patent Number: 5,287,713

[45] Date of Patent: Feb. 22, 1994

[54] METHOD AND APPARATUS FOR IRONING AND TRIMMING CYLINDRICAL PORTION OF WORKPIECE, USING STEPPED PUNCH AND DIE HAVING TAPERED DIE HOLE

[75] Inventors: Kohichi Mine, Aichi; Norio Itoh, Toyota, both of Japan

[73] Assignee: Toyota Jidosha Kabushiki Kaisha, Toyota, Japan

[21] Appl. No.: 924,447

[22] Filed: Aug. 4, 1992

[30] Foreign Application Priority Data

Aug. 5, 1991 [JP] Japan ..... 3-221044

[51] Int. Cl.[5] ..... B21D 24/16

[52] U.S. Cl. ..... 72/43; 72/327; 72/347

[58] Field of Search ..... 72/327–329, 72/347, 348, 43

[56] References Cited

U.S. PATENT DOCUMENTS

| | | | |
|---|---|---|---|
| 1,200,593 | 10/1916 | Currie | 72/327 |
| 1,524,183 | 1/1925 | Knaebel | 72/347 |
| 1,638,995 | 8/1927 | Hodge | 72/347 |
| 1,665,203 | 4/1928 | Delf | 72/327 |
| 2,611,475 | 1/1952 | Slater | 72/347 |
| 3,670,554 | 6/1972 | Kienzler | 72/347 |
| 4,346,580 | 8/1982 | Saunders | 72/349 |
| 4,541,265 | 9/1985 | Dye | 72/347 |

FOREIGN PATENT DOCUMENTS

| | | | |
|---|---|---|---|
| 0017434 | 10/1980 | European Pat. Off. . | |
| 0298560 | 1/1989 | European Pat. Off. . | |
| 1602538 | 3/1970 | Fed. Rep. of Germany . | |
| 2758254 | 7/1979 | Fed. Rep. of Germany . | |
| 2387706 | 12/1978 | France . | |
| 53-045182 | 12/1978 | Japan . | |
| 57-11733 | 1/1982 | Japan . | |
| 59-29770 | 8/1984 | Japan . | |
| 3923 | 1/1985 | Japan | 72/347 |
| 63-264222 | 11/1988 | Japan . | |
| 547263 | 2/1977 | U.S.S.R. | 72/327 |
| 1229475 | 4/1971 | United Kingdom . | |
| 1540031 | 2/1979 | United Kingdom . | |
| 2010720 | 7/1979 | United Kingdom . | |

*Primary Examiner*—Daniel C. Crane

*Attorney, Agent, or Firm*—Finnegan, Henderson, Farabow, Garrett & Dunner

[57] ABSTRACT

System for ironing a cylindrical portion of a workpiece, and trimming one axial end of the cylindrical portion remote from a radial bottom portion. The system uses a stepped punch having a small-diameter portion and a large-diameter portion, and a die having a die hole whose inner surface includes a tapered portion and a land portion adjacent to the small-diameter end of the tapered portion. With the small-diameter portion of the punch in abutting contact with the radial bottom portion of the workpiece, the punch and die are moved relative to each other axially of the workpiece, from an initial position in which the radial bottom portion is ahead of the land portion of the die in the moving direction, to a final position in which at least the leading end of the large-diameter portion of the punch is located within the land portion. This relative movement causes removal of a waste material at the trailing end of the workpiece.

16 Claims, 14 Drawing Sheets

METHOD AND APPARATUS FOR IRONING AND TRIMMING CYLINDRICAL PORTION OF WORKPIECE, USING STEPPED PUNCH AND DIE HAVING TAPERED DIE HOLE

BACKGROUND OF THE INVENTION

1. Field of the Invention

The present invention relates to a method and an apparatus for ironing and trimming a workpiece or blank which has a cylindrical portion and a radial bottom portion formed at one axial end of the cylindrical portion. More particularly, the invention is concerned with improved method and apparatus for ironing the cylindrical portion of such workpiece, and trimming the axial end of the cylindrical portion remote from the radial bottom portion.

2. Discussion of the Prior Art

An article or product in the form of a cup or container is obtained by subjecting a deep-drawn cup-like workpiece to a trimming operation, in which the axial open end of the cylindrical portion of the workpiece is trimmed. For trimming the axial open end of the cylindrical portion, the following three methods are known in the art.

The first trimming method is illustrated in FIGS. 24 and 25. Initially, a deep-drawn cup-like workpiece 500 having an outward flange at the open end is set in a die, and the outward flange is cut at a selected radial position by a punch, as shown in FIG. 24. The radial position at which the outward flange is cut determines the final depth or height of the article to be obtained as an end product 500 as shown in FIG. 25. Then, the workpiece 500 whose outward flange has been trimmed is subjected to a kind of drawing operation for straightening the trimmed outward flange while ironing the workpiece to reduce the wall thickness of the cylindrical portion, as shown in FIG. 25, whereby the end product 502 is produced.

The second trimming method includes the steps of: preparing a non-flanged workpiece 504 by either straightening the deep-drawn flanged cup-like workpiece 500 or punching off the entire portion of the outward flange of the cup-like workpiece 500; and trimming the axial open end of the thus prepared non-flanged workpiece 504, by using a shearing punch 506 which is moved in different radial directions of the workpiece 504, so that successive circumferential parts of the open end portion of the workpiece 504 are sequentially removed by shearing cuts effected by respective radial movements of the punch 506 relative to the workpiece 504, as indicated in FIG. 26.

In the third trimming method, the non-flanged workpiece 504 is first prepared as described above with respect to the second trimming method. Then, the open end portion of the workpiece 504 is continuously cut along the circumference of the cylindrical wall, by using a shearing roller 508. As shown in FIG. 27, the roller 508 which has a shearing blade on its outer circumference is rotatable about an axis parallel to the center line of the workpiece 504, and is moved along a circle coaxial with the workpiece so that the open end of the cylindrical wall of the workpiece 504 is continuously cut off by a continuous shearing cut effected by a circular movement of the roller 508.

However, all of the three trimming methods described above suffer from a considerable amount of shear droop at the trimmed open end of the end product, which is caused by cracking of the workpiece material due to penetration of the shearing punch or roller into the material.

The shear droop means a deviation of the actual shape or configuration of the open end face of the product from the nominal shape. For example, the open end face of the product may have curved or rounded edges, instead of the nominal right-angled or chamfered edges, or the actual radius of curvature of the edges may deviate from the nominal or specified radius, for instance, may be larger than the specified radius.

In particular, the first trimming method suffers from difficulty in assuring a high degree of accuracy of the height (depth) of the end product, even if the trimming of the outward flange is effected with high dimensional precision with the desired final height of the end product taken into account. Namely, the height of the end product is also determined by the wall thickness of the workpiece which is reduced by the ironing while the outward flange is straightened by the punch. However, the wall thickness of the workpiece usually has a certain amount of error, which inevitably results in an error in the height dimension of the end product.

The second and third trimming methods have another drawback. In these methods, the trimming is effected by the radial shearing cut or cuts at a selected axial position of the workpiece, whereby the height dimension of the end product can be controlled with high precision. However, the trimming is not effected at one time in these trimming methods, that is, effected by a continuous shearing cut or successive shearing cuts along the circumference of the cylindrical wall of the workpiece. Accordingly, the open end portion of the cylindrical wall of the workpiece is subjected to different shearing forces at different circumferential positions thereof, whereby the end product obtained tends to have some deformation in the cross sectional shape. The second trimming method which requires successive radial shearing cuts to trim the open end of the workpiece also suffers from a problem that the trimmed end face of the product obtained has low flatness or straightness, namely, more or less has raised and recessed portions because the successive radial shearing cuts are not performed under the same condition.

The third trimming method has a further problem that a device for moving the shearing roll 508 along the predetermined circular path is expensive.

Although the shear droop experienced in the prior art discussed above may be reduced by minimizing the n-value (work hardening exponent) of the workpiece, the reduction of the n-value results in another problem, namely, considerable deterioration of the formability of the workpiece, for example, reduction in the ease of bending or drawing of the workpiece. Therefore, the reduction in the n-value of the workpiece is not a practical solution to this problem.

SUMMARY OF THE INVENTION

It is therefore a first object of the present invention to provide an ironing and trimming method which assures not only high accuracy of the height dimension of an end product obtained, but also improved geometrical accuracy of the trimmed open end of the product, with reduced amounts of shear droop and cross sectional deformation and high flatness at the end face.

It is a second object of this invention to provide an apparatus suitable for practicing the ironing and trimming method indicated above.

The first object may be achieved according to one aspect of the present invention, which provides a method of ironing a cylindrical portion of a workpiece, and trimming one of opposite axial ends of the cylindrical portion, the workpiece having a radial bottom portion formed at the other of the opposite axial ends of the cylindrical portion, the method comprising the steps of: (i) preparing a stepped punch and a die, the punch having a small-diameter portion at one end thereof, a large-diameter portion adjacent to the small-diameter portion and a shoulder surface between the small-diameter and large-diameter portions, the shoulder surface cooperating with the large-diameter portion to define an outer circumferential edge, and cooperating with the small-diameter portion to define an inner circumferential corner, the die having a die hole whose surface including a tapered portion and a land portion adjacent to a small-diameter end of the tapered portion, the tapered portion and the land portion being formed in the order of description in a moving direction of the punch in which the punch is moved relative to the die, with the small-diameter portion leading the large-diameter portion; (ii) positioning the punch relative to the workpiece such that a leading end of the small-diameter portion of the punch is in abutting contact with the bottom portion of the workpiece; and (iii) moving the punch and the die relative to each other, to force the punch and the workpiece into the die hole of the die, for thereby (a) causing the small-diameter portion and the land portion to cooperate to effect an ironing operation on the cylindrical portion in an axial direction of the workpiece, for reducing a thickness of the cylindrical portion, while causing the inner circumferential corner of the punch to be filled with a portion of a material of the cylindrical portion which flows due to reduction of the thickness of the cylindrical portion, and (b) causing the outer circumferential edge and the land portion to cooperate to remove a waste of the material of the workpiece which exists between the large-diameter portion and the tapered portion when the outer circumferential edge reaches the land portion in the moving direction via the tapered portion of said die hole.

The second object may be achieved according to another aspect of this invention, which provides an ironing and trimming apparatus for ironing a cylindrical portion of a workpiece, and trimming one of opposite axial ends of the cylindrical portion, the workpiece having a radial bottom portion formed at the other of the opposite axial ends of the cylindrical portion, the apparatus comprising: (a) a stepped punch having a small-diameter portion at one axial end thereof, and a large-diameter portion adjacent to the small-diameter portion; (b) a die having a die hole whose surface includes a tapered portion and a land portion adjacent to a small-diameter end of the tapered portion, the tapered portion and the land portion being formed in the order of description in a moving direction of the punch in which the punch is advanced with the small-diameter portion leading the large-diameter portion; and (c) a moving device for moving the stepped punch and the die relative to each other in an axial direction of the workpiece, from an initial position in which a leading end of the small-diameter portion of the punch is ahead of the land portion of the die in the moving direction, to a final position in which at least a leading end of the large-diameter portion is located within the land portion.

According to the ironing and trimming method and apparatus of the present invention as described above, the cylindrical portion of the workpiece is ironed so as to reduce its wall thickness, while the stepped punch and the die are moved relative to each other from the initial position to the final position as defined above. As a result, a portion of the material of the cylindrical portion of the workpiece flows to the inner circumferential corner of the stepped punch, due to the ironing or wall thickness reduction of the cylindrical portion, whereby the inner circumferential corner of the punch is filled with the material. When the leading end of the large-diameter portion of the punch, more precisely, when the outer circumferential edge at the leading end of the large-diameter portion has reached the land portion of the die via the tapered portion, a waste of the material which exists between the large-diameter portion and the land portion is removed by a cooperative action of the outer circumferential edge of the punch and the land portion of the die, with the waste being pulled in the axial direction of the workpiece. Namely, when the cylindrical portion of the workpiece is ironed over a length almost equal to the desired height dimension of the end product, the outer circumferential edge defined by the large-diameter portion and the shoulder surface of the punch penetrates into the wall of the cylindrical wall as the edge approaches the land portion of the die, whereby a portion of the workpiece material flows so as to fill the inner circumferential corner defined between the shoulder surface and the small-diameter portion of the stepped punch. At a certain point during the relative movement of the outer circumferential edge of the punch and the land portion of the die, the trailing portion of the material existing between the surface of the large-diameter portion and the surface of the land portion is removed off the ironed cylindrical portion, whereby the ironed cylindrical wall is trimmed at the trailing end corresponding to the position of the outer circumferential edge. Thus, the present method and apparatus permits the workpiece to be ironed and trimmed, without a shear droop at the inner circumferential edge at the open end of the product obtained.

It will be understood that the shape or configuration of the inner circumferential edge at the open end of the product obtained from the workpiece according to the present method and apparatus is determined by the shape of the inner circumferential edge of the stepped punch. Hence, the inner edge at the open end of the product may be made right-angled, chamfered, rounded or otherwise as desired, by accordingly shaping the inner circumferential edge of the stepped punch.

Since the height of the product obtained is determined by the axial length of the small-diameter portion of the stepped punch, the height dimension of the product may be readily controlled with high accuracy.

According to the present method and apparatus, the ironing and trimming of the cylindrical portion of the workpiece are effected by a single relative movement of the stepped punch and the die, whereby the overall forming efficiency can be improved, leading to an accordingly reduced cost of manufacture of the product.

Since the ironing and trimming operations are performed by the same set of punch and die which is comparatively simple in construction, the equipment cost for the product can be considerably reduced.

The present ironing and trimming method and apparatus are also advantageous in that the trimming of the cylindrical portion of the workpiece is effected under a constant stress acting on the cylindrical portion in the radial direction over the entire circumference, whereby the product obtained is protected from deformation due to the spring-back phenomenon of the cylindrical wall after the trimming cut.

The stepped punch and die may be adapted such that a clearance percent $100(C/T_1)$ falls within a range of 30–40%, where C represents a half of a difference between the diameters of the land portion of the die and the large-diameter portion of the $T_1$ represents the wall thickness of the ironed cylindrical portion, i.e., the wall thickness of the cylindrical portion of the product. According to a research by the present inventors, it is desirable that the clearance percent be selected within the range of 30–40%. More specifically, the clearance percent is preferably at least 30% in order to sufficiently reduce the amount of shear droop at the inner circumferential edge (on the side of the stepped punch) at the open end of the product obtained, while the clearance percent is preferably 40% or less in order to sufficiently reduce the amount of burr at the outer circumference edge (on the side of the die) at the open end of the product. The clearance percent of the punch and die will be detailed in the description of preferred embodiments of the invention.

Further, the stepped punch and die may be adapted such that a thickness reduction percent $100(1-T_1/T_0)$ falls within a range of 20–40%, where T1 represents the wall thickness of the cylindrical portion of the product obtained, while T0 represents the wall thickness of the cylindrical portion of the workpiece. According to a further research by the inventors, it is desirable that the thickness reduction percent be selected within the range of 20–40%. More specifically, the thickness reduction percent is preferably at least 20% in order to sufficiently reduce the amount of shear droop at the inner circumferential edge at the open end of the product, while the thickness reduction percent is preferably 40% or less in order to sufficiently reduce the amount of burr at the outer circumference edge at the open end of the product. The thickness reduction percent will also be detailed in the description of the preferred embodiments of the invention.

The stepped punch may be provided with a channel which is open to the inner circumferential corner between the shoulder surface and the small-diameter portion. The channel is exposed to the atmospheric pressure (ambient air) or a reduced pressure (communicates with an atmospheric or reduced pressure chamber). During the ironing operation, a lubricant (liquid or solid) is generally supplied between the outer surface of the cylindrical portion of the workpiece and the surface of the die hole, and between the inner surface of the cylindrical portion of the workpiece and the outer surface of the stepped punch. An inventors' study indicated tendency of the lubricant staying at the inner circumferential corner of the stepped punch, which prevents the corner from being sufficiently filled with the portion of the workpiece material which flows into the corner due to reduction of the wall thickness of the cylindrical portion by the ironing operation. The channel indicate above functions to permit the lubricant to escape from the inner circumferential corner of the punch, thereby assuring perfect prevention of the shear droop at the inner circumferential edge at the trimmed open end of the product.

BRIEF DESCRIPTION OF THE DRAWINGS

The above and optional objects, features and advantages of this invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
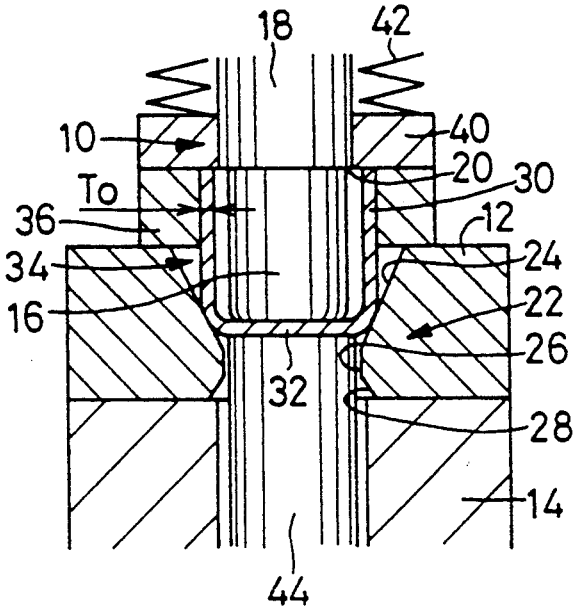
FIG. 1 is a front elevational view in cross section of an apparatus adapted to perform an ironing and trimming operation according to one embodiment of this invention.

Referring first to FIG. 1, an ironing and trimming apparatus uses a stepped punch 10 and a die 12. The stepped punch 10 is fixed to a movable punch block (not shown) while the die 12 is fixed to a stationary die block (not shown), as well known in the art. The stepped punch 10 includes a small-diameter portion 16 provided on the leading side, and a large-diameter portion 18 provided on the trailing side. The leading and trailing sides are viewed in an advancing direction of the punch 10, i.e., the direction in which the punch 10 is advanced relative to the die 12. The large-diameter portion 18 has a diameter larger than that of the small-diameter portion 16, and a shoulder surface 20 is formed between the small-diameter and large-diameter portions 16, 18. The shoulder surface 20 is perpendicular to the axial or advancing direction of the punch 10. On the other hand, the die 12 has a die hole 22 in which the stepped punch 10 is inserted when the punch 10 is advanced. The die hole 22 is defined by an inner surface which includes a first tapered portion 24, a land portion 26 and a second tapered portion 28, which are formed in the order of description in the advancing direction of the punch 10. The land portion 26 is interposed between the small ends of the first and second tapered portions 24, 28. In other words, the tapered portions 24, 28 are formed such that the diameter increases in the opposite axial directions of the die hole 22 away from the land portion 26.

A cup-like metal workpiece 34 to be ironed and trimmed by the punch 10 and die 12 is set in the die 12. The workpiece 34 has a cylindrical portion 30, and a radial bottom portion 32 at one of opposite axial ends of the cylindrical portion 30. The workpiece 34 is positioned relative to the die 12 such that the outer periphery of the radial bottom portion 32 is in abutting contact with the first tapered portion 24, while the outer circumferential surface of the cylindrical portion 30 engages the inner circumferential surface of a positioning ring 36 placed on the top face of the die 12.

In the position of FIG. 1, the leading end of the small-diameter portion 16 of the stepped punch 10 is in abutting contact with the inner surface of the radial bottom portion 32 of the workpiece 34, as a result of an advancing movement of the punch 10 by a suitable distance. As shown in FIG. 1, an annular stripper 40 slidably engages the outer circumferential surface of the large-diameter portion 18 of the stepped punch 10, and is biased by a spring 42 against the top surface of the positioning ring 36. This annular stripper 40 functions to separate the ironed and trimmed workpiece 34 (i.e., produced article or product) from the stepped punch 10. The product left in the die hole 22 is ejected out of the die hole, by a knockout bar 44, after the stepped punch 10 is retracted above the stripper 40.

Figure 2:
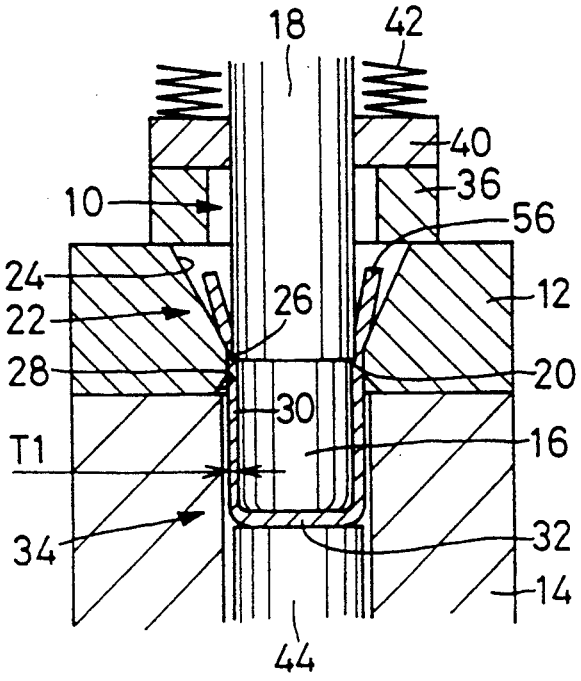
FIG. 2 is a front elevational view in cross section showing a final stage of the ironing and trimming operation on the apparatus of FIG. 1.
Figure 3:
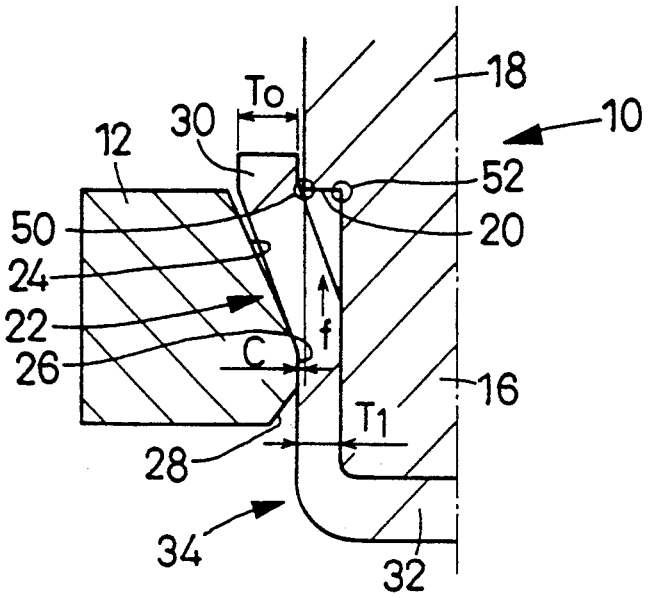
FIG. 3 is an enlarged view illustrating a process of ironing a cylindrical portion of the workpiece on the apparatus of FIG. 1.
Figure 4:
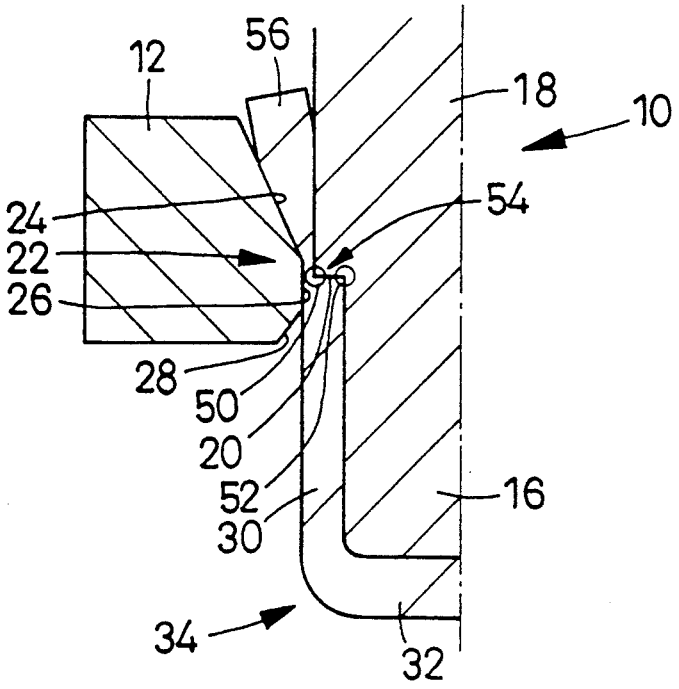
FIG. 4 is an enlarged view illustrating a trimming process following the ironing process.

It is to be understood that FIG. 1 shows the workpiece 34, and the stepped punch 10, die 12 and other components of the apparatus, when the ironing and trimming operation is started, while FIG. 2 shows these elements when the ironing and trimming operation has just been completed. The enlarged view of FIG. 3 shows the workpiece 34, punch 10 and die 12 in the process of ironing of the cylindrical portion 30 of the workpiece 34, while the enlarged view of FIG. 4 shows these elements almost at the end of the ironing and trimming operation on the workpiece 34. Details of the ironing and trimming operation on the workpiece 34 using the punch and die 10, 12 will be described by reference to FIGS. 1–4.

As the stepped punch 10 is advanced from the start position of FIG. 1 further into the die hole 22, the cylindrical portion 30 of the workpiece 34 is ironed by a cooperative action of the small-diameter portion 16 of the punch 10 and the land portion 26 of the die 12, until an outer circumferential edge 50 of the shoulder surface 20 of the punch 10 reaches the land portion 26. Thus, the thickness of the cylindrical portion 30 of the workpiece 34 is reduced by the ironing operation. As a result, a portion of the metal material of the cylindrical portion 30 flows toward the shoulder surface 20, and an inner circumferential corner 52 formed between the shoulder surface 20 and the small-diameter portion 16 is filled with the workpiece material. In FIG. 3, arrow f indicates the direction of flow of the material.

When the stepped punch 10 is advanced further into the die hole 22, the outer circumferential edge 50 of the punch 10 penetrates into the inner circumferential surface of the cylindrical portion 30 of the workpiece 34, whereby a notch 54 having a V-shape in cross section is formed at an axial position almost corresponding to the axial length of the small-diameter portion 16 of the punch 10, as indicated in FIG. 4. With a further movement of the punch 10 relative to the die 12, the workpiece material on one side of the V-shaped notch 54, namely, on the side of the small-diameter portion 16, is moved with the punch 10. On the other hand, the workpiece material on the other side of the notch 54, namely, on the side of the large-diameter portion 18, remains in the space between the first tapered portion 24 of the die 12 and the large-diameter portion 18. Thus, a tensile force acts on the portion of the material near the V-shaped notch 54, whereby the material is ruptured at the notch 54 when the tensile force exceeds a critical point. In this manner, the waste of the material existing between the large-diameter portion 18 and the first tapered portion 24 is removed or cut off from the end of the ironed cylindrical portion 30 of the workpiece 34. In other words, the ironed cylindrical portion 30 is trimmed at its open end, by the outer circumferential edge 50, which functions as a shearing blade cooperating with the land portion 26 of the die 12.

It will be understood that the end face of the ironed cylindrical portion 30, that is, the end face of the product is constituted by one of two surfaces of the V-shaped notch 54 which is on the side of the small-diameter portion 16 of the punch 10. Since this surface of the notch 54 is partially defined by the material filling the inner circumferential corner 52 of the punch 10, the shape of the inner circumferential edge at the end face of the product is controlled or determined by the shape of the cross sectional shape of the corner 52. Accordingly, the end face of the product does not have a shear droop at the inner circumferential edge.

Referring to the graph of FIG. 5, there are shown examples of a relationship between the amount of shear droop of the product and a clearance percent $100(C/T_1)$ of the punch and die 10, 12, and a relationship between the amount of burr and the clearance percent, where a thickness reduction percent $100(1-T_1/T_0)$ which will be described is 28%.

The clearance percent (%) is a proportion of the clearance C indicated in FIG. 3 with respect to the thickness $T_1$ of the cylindrical portion 30 which has been ironed. The clearance C is equal to a half of the difference between the diameters of the land portion 26 of the die 12 and the large-diameter portion 18 of the stepped punch 10. The amount of shear droop is expressed as Dmax/T1, where Dmax represents a larger one of radial and axial dimensions $D_1$ and $D_2$ of the inner circumferential edge at the open end of the cylindrical portion 30 of the workpiece 34 (product), as indicated in FIG. 5. The amount of burr is expressed as $Bmax/T_1$, where Bmax represents an axial dimension of the burr at the outer circumferential edge at the open end of the cylindrical portion 30, as also indicated in FIG. 5. The graph of FIG. 5 shows that the amounts of shear droop and burr are satisfactorily small when the clearance percent $100C/T_1$ is held within a range of 30–40%.

Figure 6:
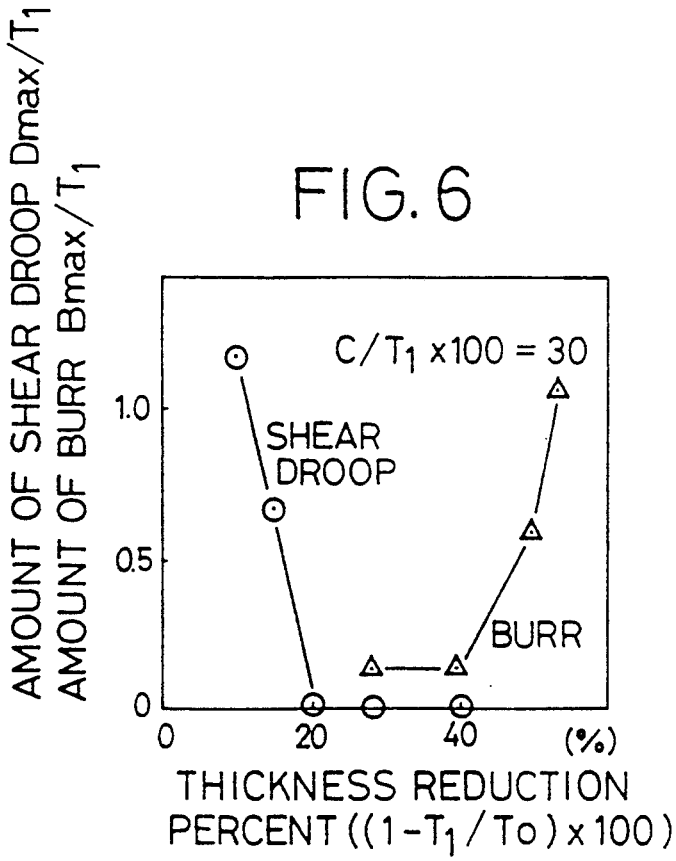
FIG. 6 is a graph indicating relationships between a thickness reduction ratio of the apparatus, and the amounts of shear droop and burr, respectively.

The graph of FIG. 6 shows examples of a relationship between the thickness reduction percent $100(1-T_1/T_0)$ and the amount of shear droop $Dmax/T_1$, and a relationship between the thickness reduction percent and the amount of burr $Bmax/T_1$, where the clearance percent $100C/T_1$ is 30%.

The thickness $T_1$ is the thickness of the cylindrical portion 30 which has been reduced by the ironing operation, as indicated above, while the thickness $T_0$ is the initial thickness of the cylindrical portion 30 before the ironing operation. The graph of FIG. 6 shows that the amounts of shear droop and burr are satisfactorily small when the thickness reduction percent $100(1-T_1/T_0)$ is held within a range of 20–40%.

The reason for an increase in the amount of burr with the thickness reduction percent larger than 40% is presumed to arise from an increase in the ductility of a portion of the material within the clearance C, due to a hydrostatic effect under a large compressive force acting on that portion of the material. Thus, a relatively long burr is generated at the inner circumferential edge on the end face of the ironed cylindrical portion 30, when the thickness reduction percent is considerably larger than the 40% level.

Figure 5:
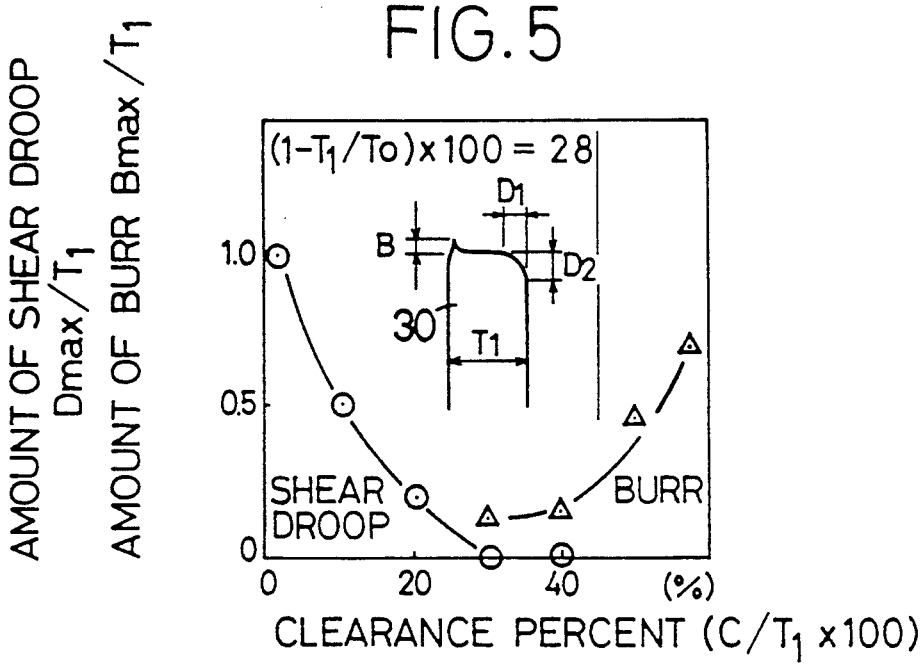
FIG. 5 is a graph indicating relationships between a clearance percent of a stepped punch and a die of the apparatus of FIG. 1, and amounts of shear droop and burr generated at the open end of the trimmed workpiece, respectively.

The graphs of FIGS. 5 and 6 were obtained for the workpiece 34 made of stainless steel, copper or SPCC.

It will therefore be understood that the workpiece 34 can be ironed and trimmed by the stepped punch 10 and die 12, with sufficiently reduced amounts of shear droop and burr generated on the face of the open end of the cylindrical portion 30 of the product obtained, when the clearance percent is selected within the 30–40% range, while the thickness reduction percent is selected within the 20–40% range. Further, the present ironing and trimming method and apparatus utilize a flow of the material of the ironed cylindrical portion 30 toward the shoulder surface 50 of the stepped punch 10, so that the material filling the corner 52 assures the right-angled, chamfered, rounded or otherwise suitably shaped inner edge at the trimmed end of the cylindrical portion 30, with a minimum amount of shear droop, while the V-shaped notch 54 formed by the outer circumferential edge of the punch 10 assures a minimum amount of burr at the outer edge at the trimmed end of the cylindrical portion 30.

In the present embodiment, the ironing of the cylindrical portion 30 of the workpiece 34 and the trimming at the open end of the portion 30 are effected in one movement of the stepped punch 10 relative to the die 12, whereby the production efficiency is improved, and the production cost is reduced.

Figure 7:
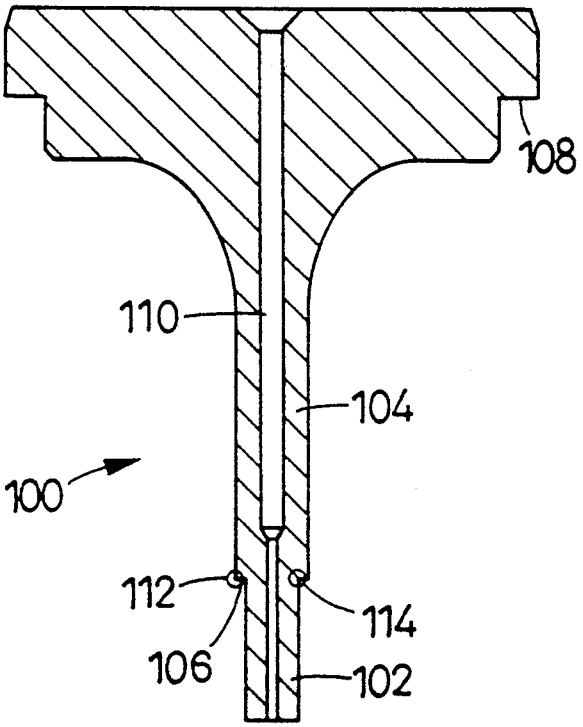
FIG. 7 is a front elevational view in cross section of a stepped punch used in another embodiment of this invention.

Experiments were conducted using an ironing and trimming apparatus which is similar to that of FIGS. 1 and 2 but uses a stepped punch 100 as illustrated in FIG. 7 in place of the stepped punch 10. However, the stepped punch 100 and the die 12 are adapted such that the clearance percent and the thickness reduction percent are held within the ranges specified above. The stepped punch 100 has a small-diameter portion 102, a large-diameter portion 104, a should surface 106 between the small-diameter and large-diameter portions 102, 104, a seat 108 at which the punch 100 is fixed to a punch block, and a guide hole 110 in which a stripper pin (not shown) is inserted. The large-diameter portion 104 and the shoulder surface 106 define an outer circumferential edge 112, while the shoulder surface 106 and the small-diameter portion 102 define an inner circumferential corner 114.

Figure 8:
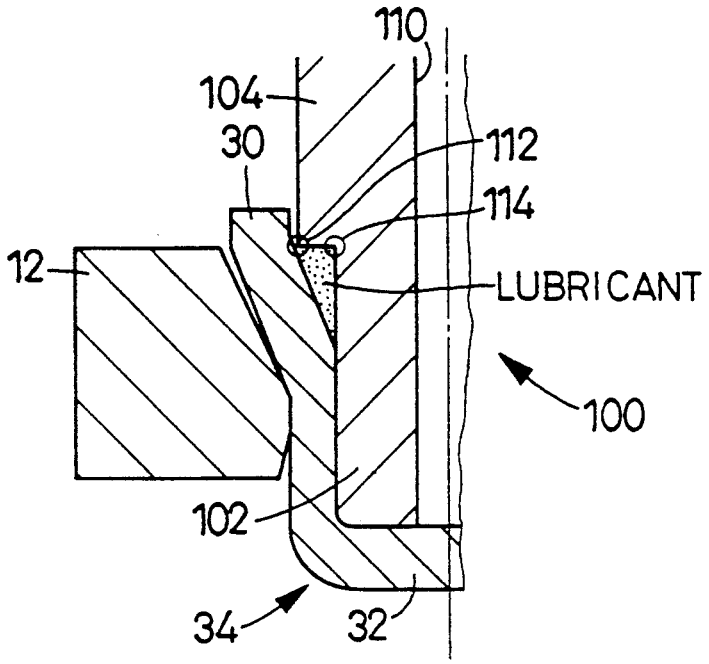
FIG. 8 is a front elevational view in cross section showing a lubricant in relation to the workpiece material and the stepped punch of FIG. 7, when the ironing and trimming operation is effected in the presence of the lubricant.
Figure 9:
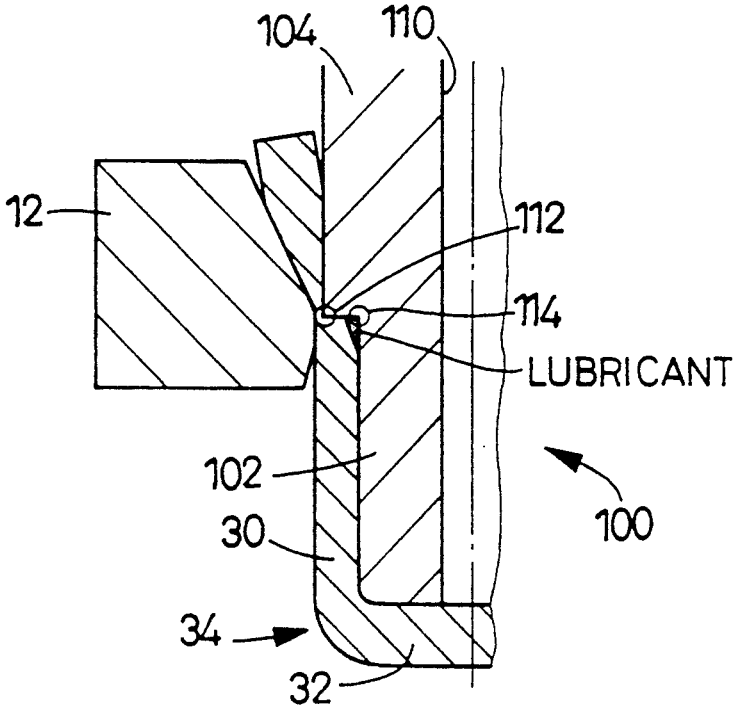
FIG. 9 is a front elevational view similar to that of FIG. 8, illustrating the lubricant in a final stage of the ironing and trimming operation.

In the experiments, a lubricant (liquid) was supplied between the die 12 and the outer circumferential surface of the workpiece 34, and between the stepped punch 100 and the inner circumferential surface of the workpiece 34, for reducing a resistance to the ironing movement of the punch, protecting the workpiece 34 (product obtained) against damaging, and for the other purposes. The experiments revealed that the use of the lubricant was not favorable in terms of the prevention of the shear droop at the inner circumferential edge of the trimmed end of the ironed cylindrical portion 30 of the product obtained. More specifically, the lubricant rather than the workpiece material tends to occupy the inner circumferential corner 114 of the punch 100, as indicated in FIGS. 8 and 9 which correspond to FIGS. 3 and 4. Since the lubricant is not compressible, it prevents the workpiece material to fill the inner circumferential corner 114.

To further clarify the influence of the lubricant on the filling of the corner 114 with the workpiece material, further experiments were conducted under the following four conditions: (i) The outer circumferential surface of the small-diameter portion 102 of the punch 100 and the inner circumferential surface of the cylindrical portion 30 of the workpiece 34 were both coated with the lubricant; (ii) Only the outer circumferential surface of the small-diameter portion 102 was coated with the lubricant; (iii) Only the inner circumferential surface of the cylindrical portion 30 was coated with the lubricant;

and (iv) Neither the small-diameter portion 102 not the cylindrical portion 30 was coated with the lubricant.

The experiments showed the absence of the shear droop in the fourth case (iv), and the generation of the shear droop locally along the inner circumferential edge of the ironed cylindrical portion 30 in the second and third cases (ii) and (iii). The experiments further showed the generation of the shear droop over the entire circumference of the inner edge of the cylindrical portion 30 in the first case (i).

Thus, it was confirmed that the lubricant prevented the workpiece material from filling the inner circumferential corner 114 of the stepped punch 100. Although the inhibition of the use of a lubricant is one measure to assure complete prevention of the shear droop at the inner circumferential edge of the trimmed end of the ironed cylindrical portion 30, the use of the lubricant is essential for the reasons indicated above.

In view of the above, the inventors found it desirable to provide the stepped punch with suitable means for preventing the lubricant from filling the inner circumferential corner of the stepped punch, while permitting the lubrication between the die and the outer circumferential surface of the workpiece and between the stepped punch and the inner circumferential surface of the workpiece. In essence, the stepped punch 10, 100 may be improved by providing means for permitting the lubricant to escape from the inner circumferential corner 52, 114 to the outside of the punch 10, 100 through the body of the punch, so as to prevent the concentration of the lubricant at the corner 52, 114. There will be described some modified forms of the stepped punch provided with such means.

Figure 10:
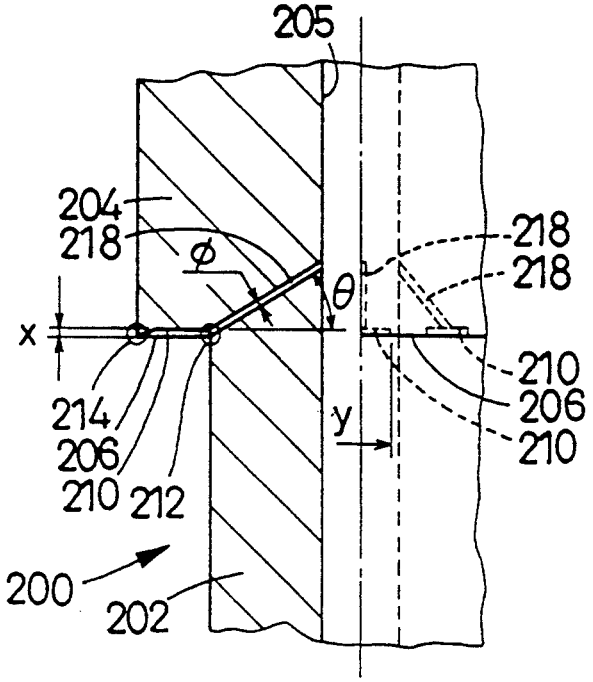
FIG. 10 is a front elevational view partly in cross section of a stepped punch used in a further embodiment of the present invention.

Referring to FIG. 10, there is shown a stepped punch 200. In this figure, the portion of the punch 200 to the left of the centerline is shown in axial cross section, while the portion to the right of the centerline is shown in front elevation.

Figure 11:
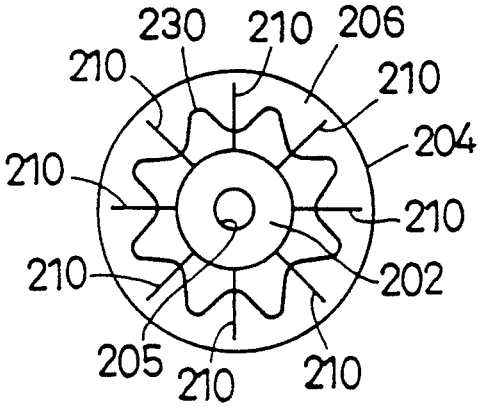
FIG. 11 is a plan view of the stepped punch of FIG. 10.

The stepped punch 200 includes a small-diameter portion 202 and a large-diameter portion 204, and has a guide hole 205 formed therethrough along the centerline. A stripper pin (not shown) is inserted in the guide hole 205. An annular shoulder surface 206 is formed between the small-diameter and large-diameter portions 202, 204, and a plurality of radial grooves 210 are formed in the shoulder surface 206 so as to extend in the radial direction of the punch 200, as shown in FIG. 11, from an inner circumferential corner 212 (radially inner end of the shoulder surface 206) defined by the shoulder surface 206 and the small-diameter portion 202. The outer ends of the radial grooves 210 are located radially inward of an outer circumferential edge 214 of the large-diameter portion 204, by a small distance. Accordingly, the grooves 210 are not open in the outer surface of the large-diameter portion 204, so that the outer circumferential edge 214 is not separated into segments by the grooves 210, to enable the edge 214 to suitably function as a trimming blade.

Each radial groove 210 is rectangular in cross section having a depth x and a width y. These dimensions x, y have influences on the dimensional and geometrical accuracy of the product obtained, and the strength of the punch 200 (surface pressure of the shoulder surface 206). For instance, the end face of the cylindrical portion 30 of the product obtained (workpiece 34) may be more or less corrugated by the grooves 210. The dimensions x and y are therefore determined depending upon the dimensional tolerance of the product, and the required strength of the punch 200. Generally, the depth x is selected within a range of 5–10 $\mu$m, while the width y is selected within a range of 5–100 $\mu$m.

The stepped punch 200 further has a plurality of radial through-holes 218 which extend from the inner circumferential corner 212 in the radially inward direction, as viewed in the axial direction of the punch, at a suitable angle $\theta$ with respect to the radial direction (with respect to a plane parallel to the shoulder surface 206), as indicated in FIG. 10. The through-holes 218 communicate with the guide hole 205, which in turn communicates with the atmosphere at the end of the large-diameter portion 204. Thus, the inner circumferential corner 212 communicates with the atmosphere through the through-holes 218 and guide hole 205.

Each through-hole 218 is a round hole having a diameter $\Phi$, which influences the height dimension of the product (since the radially outer open end of the through-hole 218 causes raised and recessed portions along the inner circumferential edge at the trimmed end of the ironed cylindrical portion 30), and also influences the strength of the stepped punch 200 (e.g., axial compressible strength. The diameter is generally selected within a range of 5–100 $\mu$m, depending upon the dimensional tolerance of the product and required strength of the punch.

Thus, the stepped punch 200 has a channel 218, 205 formed therethrough, which is open to the inner circumferential corner 212 and exposed to the atmospheric pressure.

When the ironing and trimming operation is performed using the stepped punch 200, a portion of the lubricant applied to the punch 200 and/or the inner circumferential surface of the workpiece 34 flows through the radial grooves 210, in the radially inward direction of the punch 200 from the outer circumferential edge 214 toward the inner circumferential corner 212, and then through the radial through-holes 218 from the corner 212 to the guide hole 205, whereby the lubricant mass adjacent the shoulder surface 206 and the corner 212 is discharged out of the stepped punch 200. Thus, the inner circumferential corner 212 is not filled with the lubricant, and the lubricant does not prevent the corner 212 from being filled with the workpiece material. Accordingly, the present arrangement is effective to avoid a droop at the inner circumferential edge at the trimmed end of the product (ironed and trimmed workpiece 34).

The stepped punch 200 may be modified such that the radial grooves 210 are open on the outer circumferential surface of the large-diameter portion 204, namely, at the outer circumferential edge 214. In this case, axial grooves having a suitable axial length may be formed in the outer circumferential surface of the large-diameter portion 204, so as to extend from the edge 214 in the axial direction of the punch 200, in communication with the respective radial grooves 210. The depth x and width y of these axial grooves are suitably selected, as described above with respect to the radial grooves 210.

Where the wall thickness of the workpiece 34 is relatively large and the radial dimension of the annular shoulder surface 206 is accordingly large, the radial grooves 210 should have an accordingly large radial length. In this case, a connecting groove 230 may be formed in the shoulder surface 206 so as to intersect all the radial grooves 210, as shown in FIG. 11. The connecting groove 230 is formed in a closed loop generally along a circle having a center at the center of the stepped punch 200. In the specific example of FIG. 11, the connecting groove 230 takes the form of a sinusoidal wave which has minimal points at the intersections with the radial grooves 210, and maximal points at the points intermediate between the adjacent radial grooves 210 in the circumferential direction of the loop of the groove 230. The minimal points are the points shortest to the center of the punch 200, while the maximal points are the points farthest to the center of the punch. The sinusoidal wave of the groove 230 may be replaced by a triangular wave having the minimal and maximal points similar to those of the sinusoidal wave. Further, two or more connecting grooves 230 may be provided such that the loops of these grooves are spaced apart from each other in the radial direction of the punch 200. In the present embodiment, the lubricant masses on the local portions of the shoulder surface 206 between the adjacent radial grooves 210 flow through the connecting groove 230, from the maximal points toward the minimal points, at which the lubricant masses enter the radial grooves 210, whereby the lubricant on the substantially entire area of the shoulder surface 206 can be collected and directed into the radial through-holes 218, through the connecting groove 230 as well as the radial grooves 210, with a relatively small number of the radial grooves 210.

While the stepped punch 200 is a one-piece body, the punch may consist of two separate bodies which function as the small-diameter and large-diameter portions 202, 204, respectively. Some forms of this type of stepped punch will be described by reference to FIGS. 12–20.

Figure 12:
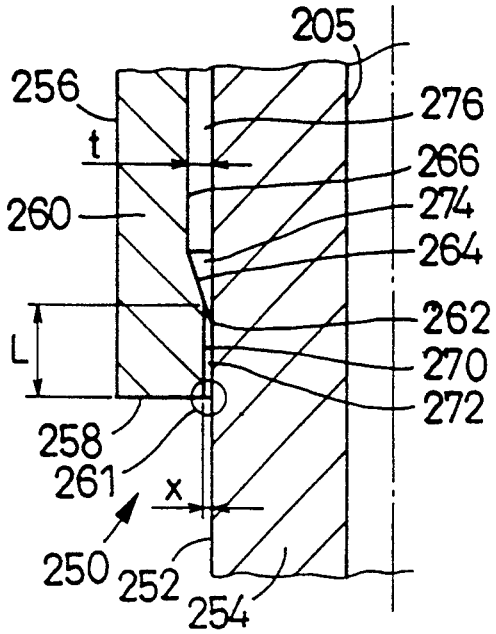
FIG. 12 is a front elevational view in cross section of a stepped punch used in a still further embodiment of the invention.

A stepped punch 250 shown in FIG. 12 consists of an inner cylindrical ironing punch 254 functioning as a small-diameter portion 252, and an outer annular punch 260 in the form of a sleeve functioning as a large-diameter portion 256 which has a shoulder surface 258. The outer annular punch 260 is fitted on the outer circumferential surface of the inner cylindrical ironing punch 254. The shoulder surface 258 of the annular punch 260 cooperates with the outer circumferential surface of the cylindrical ironing punch 254 to define an inner circumferential corner 261.

The outer annular punch 260 has a stepped inner circumferential surface defining a small-diameter hole 262, a tapered hole 264, and a large-diameter hole 266, which are formed in the order of description, as viewed in the axial direction away from the shoulder surface 258, that is, in the upward direction as seen in FIG. 12. On the surface of the small-diameter hole 262, there are formed a plurality of axial grooves 270 extending in the axial direction of the annular punch 260, so as to connect the inner circumferential corner 261 and the small-diameter end of the tapered hole 264, as shown in the bottom plan view of FIG. 13. The axial grooves 270 each having a rectangular cross sectional shape are spaced apart from each other in the circumferential direction of the annular punch 260, as is apparent from FIG. 13. The small-diameter hole 262 has an inside diameter equal to an outside diameter of the inner cylindrical ironing punch 254. The outer annular punch 260 is mounted on the inner cylindrical punch 254 such that the small-diameter hole 262 engaging the outer circumferential surface of the inner punch 254. As a result, there are formed, between the two punches 254, 260, a plurality of axial passages 272 corresponding to the axial grooves 270, a tapered annular spacing 274 corresponding to the tapered hole 264, and a straight annular spacing 276 corresponding to the large-diameter hole 266, in the order of description in the direction away from the shoulder surface 258. The tapered and straight annular spacings 274, 276 constitute an annular gap which communicates with the atmosphere at the end of the straight annular spacing 276, so that the axial passages 272 communicate with the atmosphere via the annular gap 274, 276. The axial passages 272 and the annular gap 274, 276 cooperate with each other to define a channel for fluid communication between the inner circumferential corner 261 and the atmosphere.

The depth x and width y of the axial grooves 270 are selected depending upon the dimensional tolerance of the product obtained, and the required strength of the stepped punch 250, as described above with respect to the radial grooves 210. A radial dimension t of the straight annular spacing 276 is generally determined to be at least two times the depth x of the axial grooves 270. A length L of the axial passages 272 is generally determined to be at least 5–10 times the depth x of the axial grooves 270. If the length L of the axial passages 272 is shorter than the lower limit (five times the depth x) indicated above, the resistance of the passages 272 to flows of the lubricant is insufficient, causing the lubricant to easily flow through the passages 272 at a rate higher than required, and resulting in the shortage of the lubricant on the shoulder surface 258, which in turn leads to roughening and deteriorated dimensional accuracy of the face of the trimmed end of the ironed cylindrical portion 30 of the workpiece 34 (product obtained). Where the lubricant has a high degree of fluidity, the lubrication of the punch 250 is insufficient, causing easy seizure of the punch 250. For these reasons, the axial passages 272 should have a suitable resistance to the lubricant flow.

Figure 13:
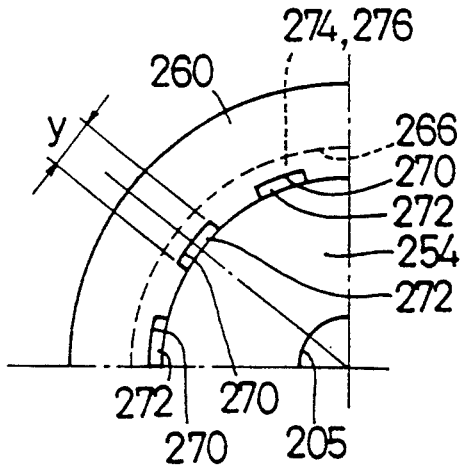
FIG. 13 is a plan view of the stepped punch of FIG. 12.

In the stepped punch 250 of FIGS. 12 and 13, the axial passages 272 communicate with the atmosphere through the single tapered annular spacing 274 and the single straight annular spacing 276. However, the axial passages 272 may communicate with the atmosphere through respective inclined passages partially defined by inclined grooves formed in the surface of the tapered hole 264, and through respective straight passages partially defined by straight grooves formed in the surface of the large-diameter hole 266. In this modified arrangement, the axial passages 272 and these inclined and straight passages cooperate to define a channel for communication between the inner circumferential corner 261 and the atmosphere.

In the embodiment of FIGS. 12 and 13, the inner circumferential surface of the outer annular punch 260 is stepped having the axial grooves 270 for the axial passages 272, and the tapered and straight annular spacings 274, 276. However, the outer annular punch 260 may have a straight inner circumferential surface. That is, the stepped punch 250 of FIGS. 12 and 13 may be replaced by a stepped punch 290 shown in FIGS. 14 and 15, which consists of an inner cylindrical ironing punch 284 and an outer annular punch 286 fitted on the inner cylindrical punch 284. In this punch 290, the inner cylindrical punch 284 has a nominal-diameter surface 280, and a stepped reduced-diameter surface 282 whose inside diameter is smaller than the diameter of the nominal-diameter surface 280. On the other hand, the outer annular punch 286 has a straight inner circumferential surface having a constant inside diameter. The nominal-diameter surface 280 of the inner punch 284 has a plurality of axial grooves 294 formed in the axial direction, so as to extend between the large-diameter end of the reduced-diameter surface 282, and an inner circumferential corner 292 defined by the shoulder surface 258 and the outer circumferential surface of the inner cylindrical punch 284. The axial grooves 294 are spaced apart from each other in the circumferential direction of the inner punch 284. With the outer annular punch 286 fitted on the inner cylindrical punch 284, there are formed therebetween axial passages 296 corresponding to the axial grooves 294, and a tapered annular spacing 298 and a straight annular spacing 300 which correspond to the reduced-diameter surface 282. In this embodiment, these passages 294 and annular spacings 298, 300 constitute a channel for communication between the corner 292 and the atmosphere.

Figure 14:
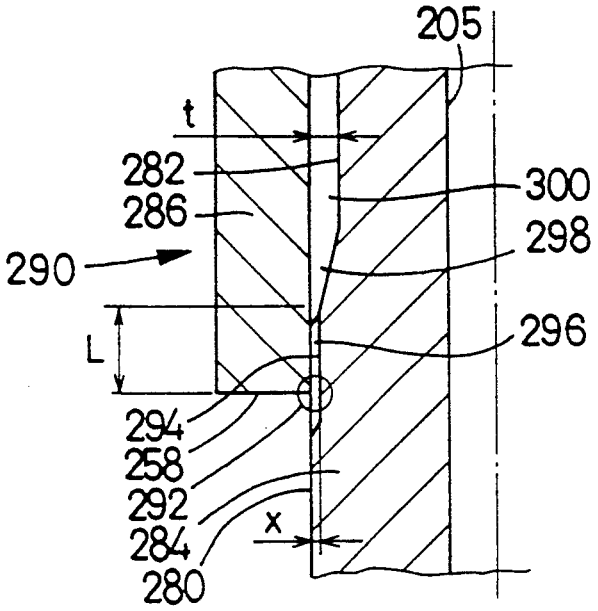
FIG. 14 is a front elevational view in cross section of a stepped punch used in a yet further embodiment of the invention.
Figure 15:
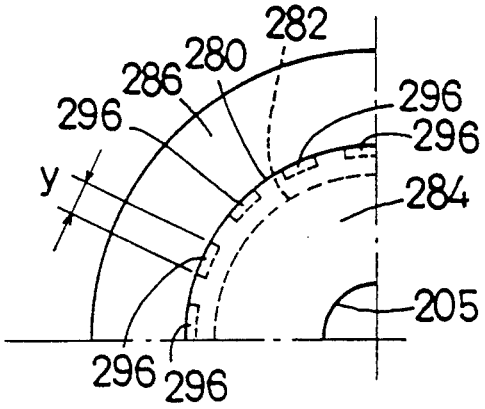
FIG. 15 is a plan view of the stepped punch of FIG. 14.
Figure 16:
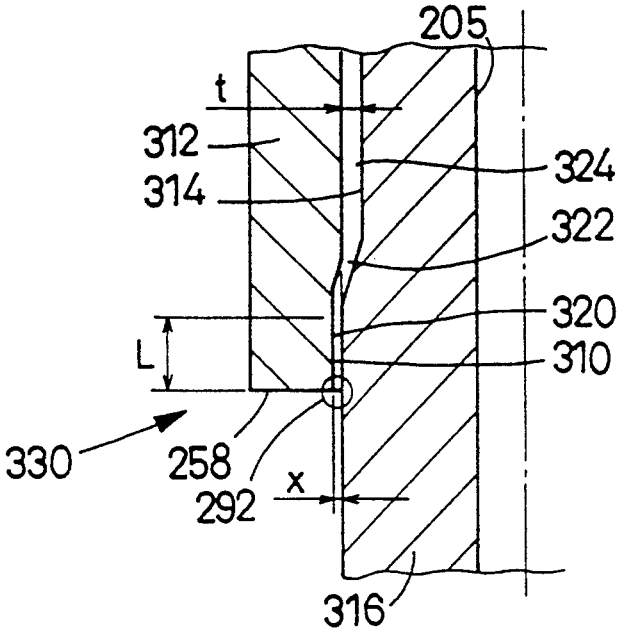
FIG. 16 is a front elevational view in cross section of a stepped punch used in still further embodiment of the invention.
Figure 17:
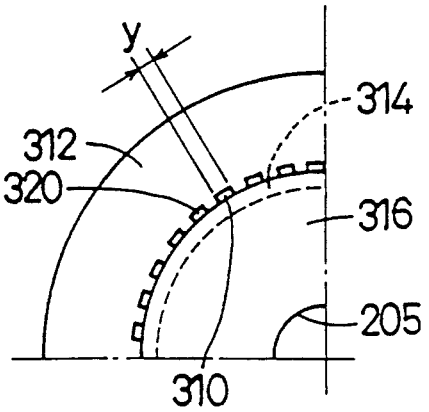
FIG. 17 is a plan view of the stepped punch of FIG. 16.

In the stepped punch 250 of FIGS. 12–13 and the stepped punch 290 of FIGS. 14–15, the axial grooves 270, 294 and the reduced-diameter surface 264, 266, 282 are both formed in the outer annular punch 260, 286. However, the stepped punches 250, 290 may be modified into a stepped punch 330 as shown in FIGS. 16 and 17, in which a plurality of axial grooves 310 are formed in the inner circumferential surface of an outer annular punch 312, while a reduced-diameter surface 314 is provided as part of the outer circumferential surface of an inner cylindrical ironing punch 316. In this case, the axial grooves 310 partially define axial passages 320, and the reduced-diameter surface 314 partially define a tapered annular spacing 322 and a straight annular spacing 324, which cooperate with the axial passages 320 to constitute a channel for communication between the inner circumferential corner 292 and the atmosphere.

Figure 18:
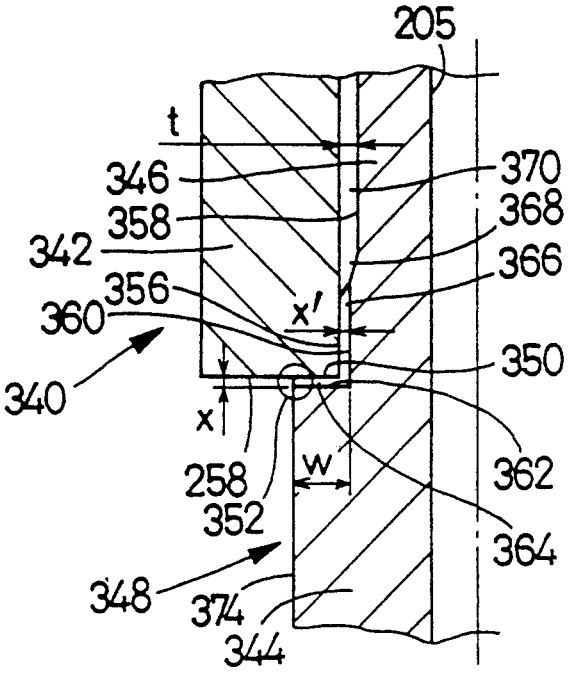
FIG. 18 is a front elevational view in cross section of a stepped punch used in yet another embodiment of the invention.
Figure 19:
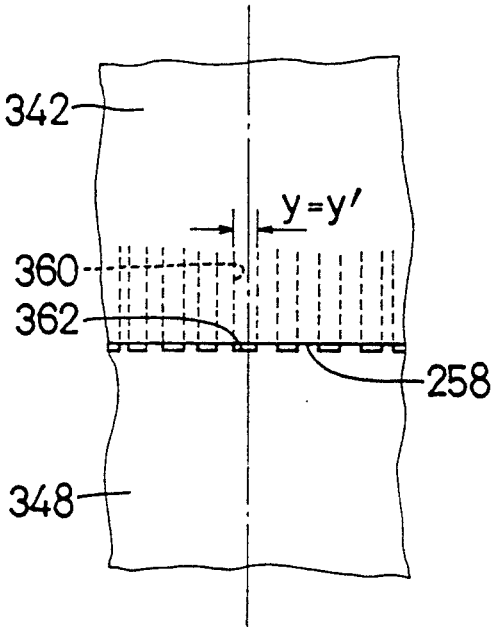
FIG. 19 is a plan view of the stepped punch of FIG. 18.
Figure 20:
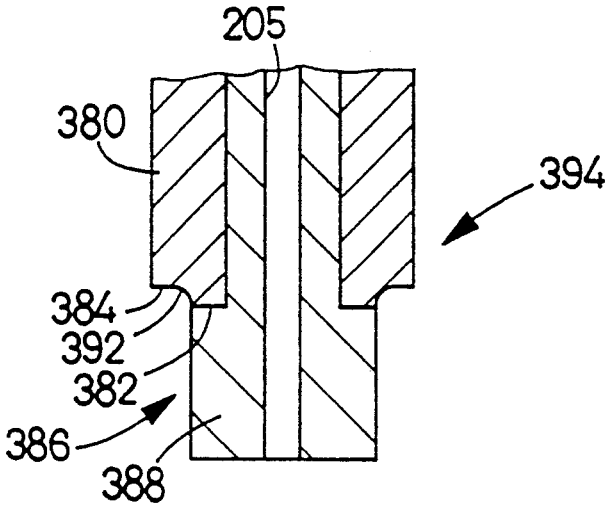
FIG. 20 is a front elevational view in cross section of a stepped punch used in still another embodiment of the invention.

In the stepped punches 250, 290 and 330 of FIGS. 12–17, the entire area of the annular end face of the outer annular punches 260, 286, 312 which partially defines the inner circumferential corner 261, 292 is exposed and functions as the shoulder surface 258. According to this arrangement, the wall thickness of the outer annular punches 260, 286, 312 should be reduced with a decrease in the final wall thickness $T_1$ of the cylindrical portion 30 of the workpiece 34 (product). If the final wall thickness $T_1$ is considerably small, the outer annular punches 260, 286, 312 do not have a sufficient strength due to the accordingly small wall thickness. In this case, a stepped punch 340 as illustrated in FIGS. 18 and 19 may be suitably used for the workpiece 34 having the cylindrical portion 34 whose wall thickness is relatively small.

The stepped punch 340 includes an outer annular punch 342 having a straight inner circumferential surface, and an inner cylindrical ironing punch 348 which consists of a large-diameter section 344 and a small-diameter section 346. The large-diameter section 344 has a shoulder surface 350 adjacent to the end of the small-diameter section 346. The outer annular punch 342 is fixed fitted on the small-diameter section 346 of the inner cylindrical ironing punch 348, such that the shoulder surface 350 of the inner punch 348 is in abutting contact with a radially inner portion of the end face of the outer annular punch 342 adjacent to the large-diameter section 344. In the instant stepped punch 340, an inner circumferential corner 352 is defined by the outer circumferential surface of the large-diameter section 344 of the inner cylindrical punch 348, and the exposed radially outer portion of the end face of the outer annular punch 342, which radially outer portion functions as the shoulder surface 258. The radial dimension w of the shoulder surface 350 of the inner cylindrical punch 348 is determined depending upon the required strength of the stepped punch 340 (in particular, the required strength of the outer annular punch 342). This arrangement permits the wall thickness of the outer annular punch 342 to be larger than the final wall thickness $T_1$ of the cylindrical portion 30 of the workpiece 34, whereby the outer annular punch 342 may be given a sufficient strength, irrespective of the final wall thickness $T_1$.

The outer surface of the small-diameter section 346 of the inner cylindrical ironing punch 348 inciudes a nominal-diameter surface 356 adjacent to the shoulder surface 350 of the large-diameter section 344, and a reduced-diameter surface 358 extending from the nominal-diameter surface 356. The nominal-diameter surface 356 has an outside diameter which is equal to the inside diameter of the outer annular punch 342. The outer annular punch 342 is mounted on the inner punch 348 such that the inner circumferential surface of the outer punch 342 engages the nominal-diameter surface 356 of the small-diameter section 346 of the inner punch 348.

The nominal-diameter surface 356 has a plurality of axial grooves 360 extending in the axial direction, between the shoulder surface 350 and the large-diameter end of the reduced-diameter surface 358. These axial grooves 360 are spaced apart from each other in the circumferential direction of the small-diameter section 346. The shoulder surface 350 has a plurality of radial grooves 362 which communicate at their radially inner ends with the corresponding ends of the axial grooves 360. The radial grooves 362 are open, at the radially outer ends, on the outer circumferential surface of the large-diameter section 344, so that the radial grooves 362 communicate with the inner circumferential corner 352.

With the outer annular punch 342 fitted on the inner cylindrical ironing punch 348, there are formed therebetween a plurality of radial passages 364 corresponding to the radial grooves 362, a plurality of axial passages 366 corresponding to the axial grooves 360, and a tapered annular spacing 368 and a straight annular spacing 370 which correspond to the reduced-diameter surface 358. The straight annular spacing 370 is exposed to the atmosphere, at the end remote from the tapered annular spacing 368. In the present embodiment of FIGS. 18 and 19, the radial passages 364, axial passages 366, and the tapered and straight annular spacings 360, 370 constitute a channel for communication between the inner circumferential corner 352 and the atmosphere.

The depth x (indicated in FIG. 18) and the width y (indicated in FIG. 19) of the radial grooves 362 are determined in the same manner as described above with respect to the radial grooves 210. The depth x' and width y' of the axial grooves 360 are equal to the depth x and width y of the radial grooves 362 respectively. It is noted that FIG. 19 is a front elevation of the punches 348, 342, which indicates the widths y, y' of the grooves 362 and 360 in the diametric direction of the punches 340, 342.

If the length of the radial passages 364 (equal to the radial width w of the shoulder surface 350 of the punch 348) is not large enough to give an adequate resistance to the lubricant flow, the axial passages 366 should provide a supplemental resistance, which is added to the resistance provided by the radial passages 364, so as to provide a suitable total resistance value. If the radial passages 364 have a length suitable for providing the adequate resistance to the lubricant flow, the axial grooves 360 may be dimensioned as desired with a comparatively high degree of freedom. For example, the width y' of the axial grooves 360 may be made larger than the width y of the radial grooves 362.

When the workpiece 34 is ironed and trimmed using the stepped punch 340, for example, the trimmed end of the cylindrical portion 30 of the workpiece 34 (product obtained) has a right-angled sharp inner circumferential edge corresponding to the inner circumferential corner 352 of the stepped punch 340. However, the corner 352 may be otherwise suitably shaped, for example, chamfered or rounded, depending upon the desired shape or configuration of the inner circumferential edge on the face of the trimmed end of the ironed cylindrical portion 30. For instance, a stepped punch 394 shown in FIG. 20 uses an outer annular punch 380 having a stepped end face, which consists of a radially inner straight portion 382, a radially outer straight portion 384, and a radially intermediate curved portion 392 connecting the two straight portions 382, 384. The radially inner straight portion 382 has an outside diameter equal to the diameter of a large-diameter section 388 of an inner punch 386 on which the outer punch 380 is mounted. With the outer punch 380 fitted on the small-diameter section of the inner punch 386, the outer circumferential surface of the large-diameter section 388 of the outer punch 386 is flush with the inner end of the radially outer curved portion 384 of the end face of the outer punch 380. In this embodiment, the radially intermediate curved portion 392 functions as an inner circumferential corner which corresponds to a fillet to be formed at the inner circumferential edge at the trimmed end of the ironed cylindrical portion 30 of the workpiece 34. The curvature of the curved portion 392 is determined upon the desired curvature of the fillet. The outer circumferential edge of the radially outer straight portion 384 functions as a blade for trimming the open end of the cylindrical portion 30.

In the embodiment of FIGS. 18 and 19, the shoulder surface 350 of the inner punch 348 perpendicular to the axis of the stepped punch 340 is held in abutting contact with the end face of the outer punch 342 which is also perpendicular to the axis of the punch 340. However, the shoulder surface 350 and the contacting portion of the end face of the outer punch 342 may lie in a plane which is inclined with the axis of the punch 340, that is, intersects the axis at an angle other than 90°.

In the stepped punch 340 of FIGS. 18 and 19, the radial and axial grooves 362, 360 and the reduced-diameter surface 358 are all formed on the inner cylindrical ironing punch 348. However, similar passages and reduced-diameter surface may be formed on the outer annular punch 342 so that these passages and reduced-diameter surface cooperate with the grooves and surface 362, 360, 358 of the outer punch 348 to define the radial and axial passages 364, 366 and tapered and straight annular spacings 368, 370. Further, the passages 362, 360 and reduced-diameter surface 358 may be selectively provided on one and the other of the inner and outer punches 348, 342.

While the various stepped punches having various forms of channels for communication between the inner circumferential corner of the stepped punch and the atmosphere have been described above by reference to FIGS. 10–20, these channels permit the inner circumferential corner of each stepped punch to be filled with the workpiece material, with a minimum amount of the lubricant staying at or near the corner, thereby assuring geometrical or configurational accuracy of the inner circumferential edge formed at the trimmed end of the cylindrical portion 30 of the workpiece 34.

In addition to the above advantage owing to the provision of the channel, the particular embodiments of FIGS. 10–20 have further advantages.

In the stepped punch 200 of FIG. 10, the end face of the ironed and trimmed cylindrical portion 30 of the workpiece 34 contacts the shoulder surface 206 which has the radial grooves 210. Therefore, the radial grooves 210 facilitate the removal of the processed workpiece 34 (product obtained), with the ambient air being easily introduced between the workpiece 34 and the stepped punch 200.

The stepped punch 250 of FIGS. 12 and 13, stepped punch 290 of FIGS. 14 and 15, stepped punch 330 of FIGS. 16 and 17, and stepped punch 340 of FIGS. 18 and 19 are not provided with grooves on the shoulder surface 258. Therefore, the end face of the ironed cylindrical portion 30 product obtained from the workpiece 34) is not undesirably corrugated by the grooves.

In the embodiment of FIG. 10, the end face of the ironed cylindrical portion 30 is corrugated by the radial grooves 210 formed on the shoulder surface 206. When the end face of the product to be produced has a corrugation in the form of radial strips, the stepped punch 200 of FIG. 10 is suitably used, since the otherwise required subsequent step for forming such corrugation is eliminated.

The axial grooves 294 provided on the stepped punch 290 of FIGS. 14 and 15 may be formed so as to extend over the exposed portion of the nominal-diameter surface 280 of the inner cylindrical punch 284, if axial strips are provided on the inner circumferential surface of the cylindrical portion of a cup-like product. In this case, the axial grooves 294 function to form such axial strips on the inner surface of the product. The axial strips facilitate sliding movement of a certain member relative to the inner wall surface of the cup-like product. The stepped punch 290 provided with such axial grooves eliminates the otherwise required subsequent step for forming the axial strips on the cup-like product.

Where the workpiece 34 is made of a high-strength material such as heat-resistant steel, or a material such as stainless steel, aluminum and titanium, the expected service life of the small-diameter portion of the stepped punch is shorter than that of the large-diameter portion of the punch. In this sense, the stepped punches 250, 290, 330, 340 and 394 of FIGS. 12–20 are advantageous, since only the inner cylindrical ironing punch 254, 284, 316, 348, 386 can be replaced with a new one.

Figure 21:
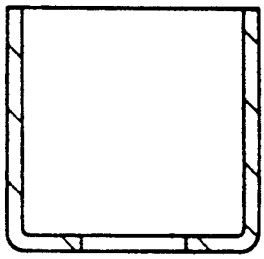
FIG. 21 is a front elevational view in cross section showing another type of workpiece different from that shown in FIG. 1.
Figure 22:
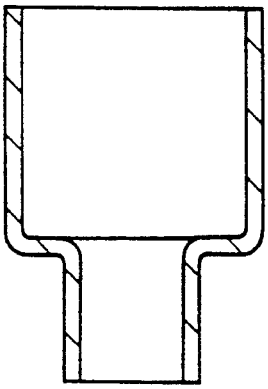
FIG. 22 is a front elevational view of a further type of workpiece.
Figure 23:
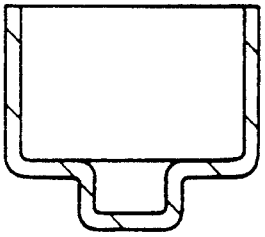
FIG. 23 is a front elevational view of a still further type of workpiece.
Figure 24:
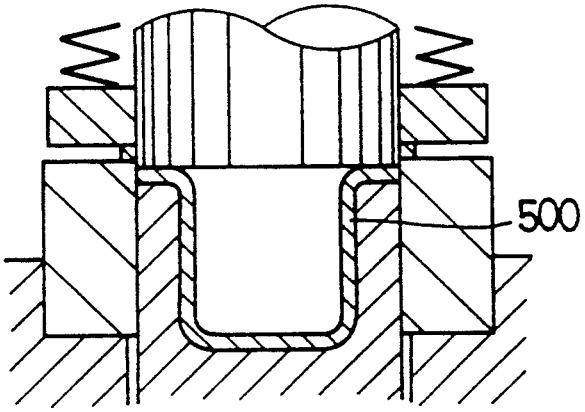
FIG. 24 PRIOR ART
FIG. 24 is a front elevational view in cross section showing a known method of trimming a cylindrical portion of a workpiece.
Figure 25:
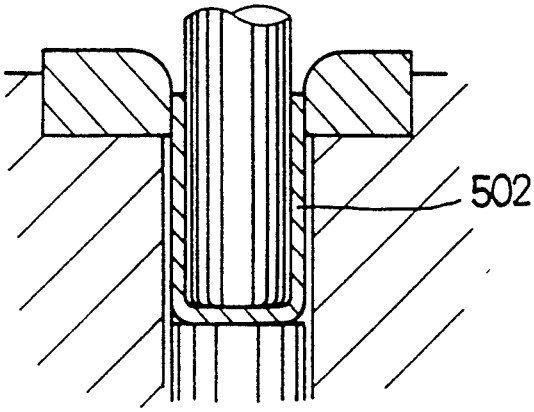
FIG. 25 PRIOR ART
FIG. 25 is a front elevational view in cross section showing a known ironing method practiced after the trimming method of FIG. 24.
Figure 26:
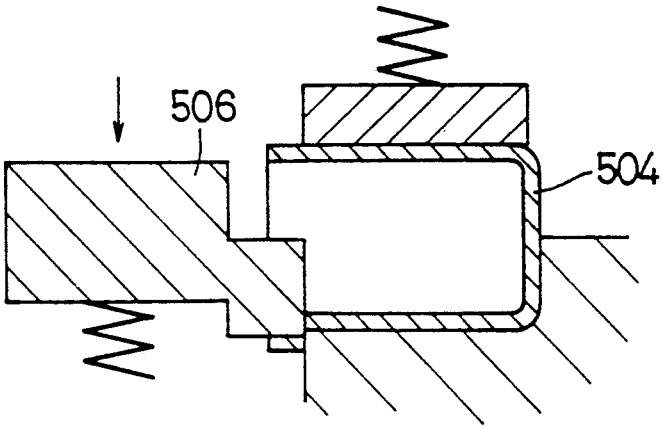
FIG. 26 PRIOR ART
FIG. 26 is a front elevational view in cross section of another known trimming method for a cylindrical workpiece.
Figure 27:
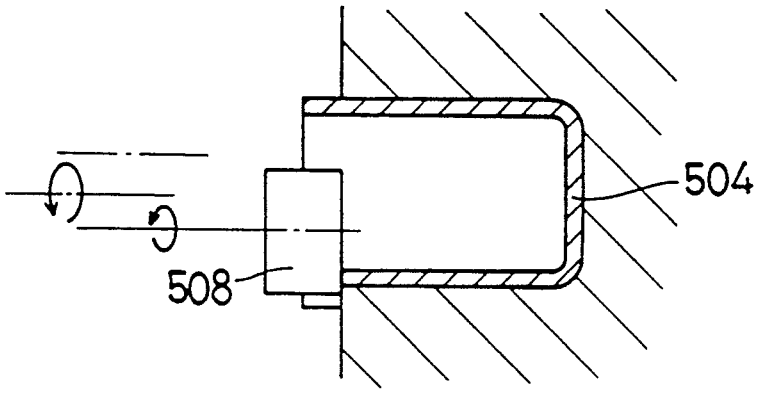
FIG. 27 PRIOR ART
FIG. 27 is a front elevational view in cross section of a further known trimming method for a cylindrical workpiece.

While the various stepped punches have been described in connection with the workpiece 34 whose cylindrical portion 30 is entirely closed at one end by the radial bottom portion 32, the ironing and trimming method and apparatus according to the present invention may be used for a workpiece other than the workpiece 34, provided that the workpiece has a cylindrical portion, and a radial bottom portion at one of opposite axial ends of the cylindrical portion. For instance, the workpiece may have an opening formed through the radial bottom wall as shown in FIG. 21. The workpiece of FIG. 21 may be considered a cylinder having an inward flange at one axial end thereof. The workpiece of FIG. 21 may be modified as shown in FIG. 22. Namely, the workpiece has a first and a second cylindrical portion which have different diameters and whose axial lengths are defined by a radial wall portion formed therebetween. In this case, the radial wall portion may be considered a radial bottom portion for the first cylindrical portion. The workpiece of FIG. 21 may also be modified as shown in FIG. 23. That is, the workpiece has a cylindrical portion, and a radial bottom portion which has a recessed central portion defining a recess having a suitable depth in the axial direction.

While the present invention has been described in its presently preferred embodiments with a certain degree of particularity, it is to be understood that the invention is not limited to the details of the illustrated embodiments, but may be embodied with various changes, modifications and improvements, which may occur to those skilled in the art, without departing from the spirit and scope of the invention defined in the following claims.

What is claimed is:

1. A method of ironing a cylindrical portion of a workpiece, and trimming one of opposite axial ends of said cylindrical portion, said workpiece having a radial bottom portion formed at the other of said opposite axial ends of said cylindrical portion, said method comprising the steps of:

preparing a stepped punch and a die, said punch having a small-diameter portion at one end thereof, a large-diameter portion adjacent to said small-diameter portion and a shoulder surface between said small-diameter and large-diameter portions, said shoulder surface cooperating with said large-diameter portion to define an outer circumferential edge, and cooperating with said small-diameter portion to define an inner circumferential corner, said die having a die hole with a surface including a tapered portion and a land portion adjacent to a small-diameter end of said tapered portion, said tapered portion and said land portion being formed in the order of description in a moving direction of said punch in which said punch is moved relative to said die, with said small-diameter portion leading said large-diameter portion;

positioning said punch relative to said workpiece such that a leading end of said small-diameter portion of the punch is in abutting contact with said bottom portion of the workpiece, with a lubricant applied between said stepped punch and an inner circumferential surface of said workpiece; and moving said punch and said die relative to each other, to force said punch and said workpiece into said die hole of said die, for thereby (a) causing said small-diameter portion and said land portion to cooperate to effect an ironing operation on said cylindrical portion in an axial direction of the workpiece, for reducing a thickness of said cylindrical portion, while causing said inner circumferential corner of said punch to be filled with a portion of a material of said cylindrical portion which flows due to reduction of the thickness of said cylindrical portion, said portion of the material forcing said lubricant to flow from said inner circumferential corner of said stepped punch, through a channel formed through said stepped punch, to a space under atmospheric pressure or less, and (b) causing said outer circumferential edge and said die to cooperate to remove a waste of the material of the workpiece which exists between said large-diameter portion and said tapered portion, thereby to trim said cylindrical portion at said one of opposite axial ends thereof when said outer circumferential edge reaches said land portion in said moving direction via said tapered portion of said die hole.

2. A method according to claim 1, wherein said step of preparing said stepped punch and said die comprises determining a thickness reduction percent $100(1-T_1/T_0)$ to be within a range of 20–40%, where $T_1$ represents the thickness of said cylindrical portion of said workpiece after said thickness has been reduced by said ironing operation, while $T_0$ represents the thickness of said cylindrical portion before said thickness has been reduced by said ironing operation.

3. An ironing and trimming apparatus for ironing a cylindrical portion of a workpiece, and trimming one of opposite axial ends of said cylindrical portion, said workpiece having a radial bottom portion formed at the other of said opposite axial ends of said cylindrical portion, said apparatus comprising:

a stepped punch having a small-diameter portion at one axial end thereof, a large-diameter portion adjacent to said small-diameter portion, and a shoulder surface between said small-diameter and large-diameter portions, said shoulder surface cooperating with said large-diameter portion to define an outer circumferential edge, and cooperating with said small-diameter portion to define an inner circumferential corner;

a die having a die hole with a surface including a tapered portion and a land portion adjacent to a small-diameter end of said tapered portion, said tapered portion and said land portion being formed in the order of description in a moving direction of said punch in which said punch is advanced with said small-diameter portion leading said large-diameter portion;

a moving device for moving said stepped punch and said die relative to each other in an axial direction of said workpiece, from an initial position in which a leading end of said small-diameter portion of said punch is ahead of said land portion of said die in said moving direction, to a final position in which said cylindrical portion is trimmed at said one of opposite axial ends thereof, by said outer circumferential edge and said die; and said stepped punch having a channel formed therethrough, said channel being open at one of opposite ends thereof to said inner circumferential corner and exposed at the other end to atmospheric or lower pressure.

4. An ironing and trimming apparatus according to claim 3, wherein said shoulder surface has a plurality of radial grooves which communicate with said channel.

5. An ironing and trimming apparatus according to claim 4, wherein said shoulder surface further has at least one connecting groove each of which intersects all of said plurality of radial grooves.

6. An ironing and trimming apparatus according to claim 3, wherein said channel includes a plurality of axial passages which are spaced from each other in a circumferential direction of said punch, and a plurality of radial passages which communicate with said axial passages, respectively, and which lead to said inner circumferential corner.

7. An ironing and trimming apparatus according to claim 3, wherein said stepped punch includes an inner cylindrical ironing punch having said small-diameter portion, and further includes an outer annular punch in the form of a sleeve having said large-diameter portion, said outer annular punch being fitted on an outer circumferential surface of said inner cylindrical ironing punch.

8. An ironing and trimming apparatus according to claim 7, wherein at least a portion of said channel is defined by the outer circumferential surface of said inner cylindrical ironing punch and an inner circumferential surface of said outer annular punch.

9. An ironing and trimming apparatus according to claim 9, said outer and inner circumferential surfaces of said inner cylindrical ironing punch and said outer annular punch have respective mutually contacting portions over a predetermined axial length from a leading end of said outer annular punch, one of said mutually contacting portions having a plurality of axial grooves which define a part of said channel.

10. An ironing and trimming apparatus according to claim 9, wherein said outer and inner circumferential surfaces of said inner cylindrical ironing punch and said outer annular punch further have respective mutually facing portions which define a gap communicating with said plurality of axial grooves and having a cross sectional area larger than a total cross sectional area of said axial grooves.

11. An ironing and trimming apparatus according to claim 7, wherein said inner cylindrical ironing punch includes a large-diameter section as said small-diameter portion, a small-diameter section having a smaller diameter than said large-diameter section and inserted in said outer annular punch, and a shoulder surface formed between said large-diameter and small-diameter sections, said shoulder surface contacting a leading end face of said outer annular punch, one of said shoulder surface of said inner cylindrical ironing punch and said leading end face of said outer annular punch having a plurality of radial grooves which define a portion of said channel.

12. An ironing and trimming apparatus according to claim 3, said stepped punch has a shoulder surface between said small-diameter and large-diameter portions, said shoulder surface cooperating with said small-diameter portion to define an inner circumferential corner, said inner circumferential corner having a shape for forming a sharp inner edge on a circumferential end face at said one of said opposite axial ends of said cylindrical portion of the workpiece as said stepped punch and said die move relative to each other to said final position.

13. An ironing and trimming apparatus according to claim 3, wherein said stepped punch has a shoulder surface between said small-diameter and large-diameter portions, said shoulder surface cooperating with said small-diameter portion to define an inner circumferential corner, said inner circumferential corner having a shape for forming a chamfer at an inner end of a circumferential end face at said one of said opposite ends of said cylindrical portion of the workpiece as said stepped punch and said die move relative to each other to said final position.

14. An ironing and trimming apparatus according to claim 3, wherein said stepped punch has a shoulder surface between said small-diameter and large-diameter portions, said shoulder surface cooperating with said small-diameter portion to define an inner circumferential corner, said inner circumferential corner having a shape for forming a fillet at an inner end of a circumferential end face at said one of said opposite ends of said cylindrical portion of the workpiece as said stepped punch and said die move relative to each other to said final position.

15. A method of ironing a cylindrical portion of a workpiece, and trimming one of opposite axial ends of said cylindrical portion, said workpiece having a radial bottom portion formed at the other of said opposite axial ends of said cylindrical portion, said method comprising the steps of:

preparing a stepped punch and a die, said punch having a small-diameter portion at one end thereof, a large-diameter portion adjacent to said small-diameter portion and a shoulder surface between said small-diameter and large-diameter portions, said shoulder surface cooperating with said large-diameter. portion to define an outer circumferential edge, and cooperating with said small-diameter portion to define an inner circumferential corner, said die having a die hole with a surface including a tapered portion and a land portion adjacent to a small-diameter end of said tapered portion, said tapered portion and said land portion being formed in the order of description in a moving direction of said punch in which said punch is moved relative to said die, with said small-diameter portion leading said large-diameter portion;

said step of preparing said stepped punch and laid die comprising determining a clearance percent $100C/T_1$ to be within a range of 30–40%, where C represents a half of a difference between a diameter of said land portions of said die and a diameter of said large-diameter portion of said punch, while $T_1$ represents the thickness of said cylindrical portion of the workpiece after said thickness has been reduced by said ironing operation;

positioning said punch relative to said workpiece such that a leading end of said small-diameter portion of the punch is in abutting contact with said bottom portion of the workpiece; and moving said punch and said die relative to each other, to force said punch and said workpiece into said die hole of said die, for thereby (a) causing said small-diameter portion and said land portion to cooperate to effect an ironing operation on said cylindrical portion in an axial direction of the workpiece, for reducing a thickness of said cylindrical portion, while causing said inner circumferential corner of said punch to be filled with a portion of material of said cylindrical portion which flows due to reduction of the thickness of said cylindrical portion, and (b) causing said outer circumferential edge and said die to cooperate to remove a waste of the material of the workpiece which exists between said large-diameter portion and said tapered portion, thereby to trim said cylindrical portion at said one of opposite axial ends thereof when said outer circumferential edge reaches said land portion in said moving direction via said tapered portion of said die hole.

16. An ironing and trimming apparatus for ironing a cylindrical portion of a workpiece, and trimming one of opposite axial ends of said cylindrical portion, said workpiece having a radial bottom portion formed at the other of said opposite axial ends of said cylindrical portion, said apparatus comprising:

a stepped punch having a small-diameter portion at one axial end thereof, and a large-diameter portion adjacent to said small-diameter portion;

a die having a die hole with a surface including a tapered portion and a land portion adjacent to a small-diameter end of said tapered portion, said tapered portion and said land portion being formed in the order of description in a moving direction of said punch in which said punch is advanced with said small-diameter portion leading said large-diameter portion;

said stepped punch being formed such that a ratio of a difference between diameters of said land portion and said large-diameter portion to a difference between said land portion and said small-diameter portion is within a range of 0.2–0.4; and a moving device for moving said stepped punch and said die relative to each other in an axial direction of said workpiece, from an initial position in which a leading end of said small-diameter portion of said punch is ahead of said land portion of said die in said moving direction, to a final position in which at least a leading end of said large-diameter portion is located within said land portion, thereby to trim the cylindrical portion at said one axial end of the workpiece.

* * * * *

UNITED STATES PATENT AND TRADEMARK OFFICE

CERTIFICATE OF CORRECTION

PATENT NO. : 5,287,713

DATED : February 22, 1994

INVENTOR(S) : Kohichi MINE et al.

It is certified that error appears in the above-identified patent and that said Letters Patent is hereby corrected as shown below:

Claim 12, column 21, line 39, before "said" insert --wherein--.

Claim 15, column 22, line 15, delete the period; and
line 26, change "laid" to --said--.

Signed and Sealed this

Fifth Day of July, 1994

*Attest:*

*Attesting Officer*

BRUCE LEHMAN

*Commissioner of Patents and Trademarks*